US006568579B2

(12) United States Patent
Mochizuki

(10) Patent No.: US 6,568,579 B2
(45) Date of Patent: May 27, 2003

(54) STAPLER APPARATUS THAT DOES NOT WASTE STAPLES

(75) Inventor: Naoto Mochizuki, Kofu (JP)

(73) Assignees: ACCO Brands, Inc., Lincolnshire, IL (US); NISCA Corporation, Yamanashi-ken (JP)

( * ) Notice: Subject to any disclaimer, the term of this patent is extended or adjusted under 35 U.S.C. 154(b) by 0 days.

(21) Appl. No.: 09/873,268

(22) Filed: Jun. 5, 2001

(65) Prior Publication Data

US 2002/0030077 A1 Mar. 14, 2002

(30) Foreign Application Priority Data

Jun. 5, 2000 (JP) ..... 2000-167136

(51) Int. Cl.[7] ..... B25C 5/04
(52) U.S. Cl. ..... 227/131; 227/119; 227/136
(58) Field of Search ..... 227/131, 119, 227/136, 7, 8, 2, 155

(56) References Cited

U.S. PATENT DOCUMENTS

| | | | | |
|---|---|---|---|---|
| 5,076,483 A | | 12/1991 | Olesen | 227/131 |
| 5,230,457 A | | 7/1993 | Hiroi et al. | 227/2 |
| 5,460,314 A | | 10/1995 | Udagawa | 227/155 |
| 5,474,222 A | | 12/1995 | Kanai et al. | 227/131 |
| 5,660,314 A | | 8/1997 | Magnusson et al. | 227/2 |
| 5,791,548 A | | 8/1998 | Udagawa et al. | 227/131 |
| 5,823,415 A | * | 10/1998 | Udagawa et al. | 227/136 |
| 6,050,471 A | * | 4/2000 | Yagi | 227/131 |
| 6,135,337 A | | 10/2000 | Harris et al. | 227/131 |
| 6,371,351 B1 | * | 4/2002 | Magnusson | 227/131 |

FOREIGN PATENT DOCUMENTS

| | | |
|---|---|---|
| JP | 10-000578 | 1/1998 |
| JP | 2000-167782 | 6/2000 |

* cited by examiner

*Primary Examiner*—Scott A. Smith
(74) *Attorney, Agent, or Firm*—Michael Best & Friedrich LLP

(57) ABSTRACT

A stapler is provided that does not waste any staples when a staple cartridge or sheet of staples is replaced. The stapler includes a sheet of staples, a mounting unit equipped with a cartridge for housing the sheet of staples and a driver mechanism that draws out the sheet of staples from the cartridge. The mounting unit has a reverse motion stopping mechanism that prevents the sheet of staples from moving back into the cartridge. The reverse motion stopping mechanism makes contact with the sheet of staples when the mounting unit is installed and the reverse motion stopping mechanism releases contact with the sheet of staples when the mounting unit is removed.

22 Claims, 7 Drawing Sheets

STAPLER APPARATUS THAT DOES NOT WASTE STAPLES

TECHNICAL FIELD

The present invention relates to a stapler used to staple a stack of paper discharged from an image forming device such as a photocopier or a printer.

BACKGROUND

The following is an explanation of the stapling operation of a prior art stapler with reference to FIG. 1 and FIG. 2. The sheet of staples S shown in FIG. 1 consists of a series of single staples. The sheet of staples S is rolled up and housed in the housing unit 50*a* of the cartridge 50. Here, the sheet of staples S extends from the extraction opening 50*b* in the housing unit 50*a*. The cartridge 50 mounted in the housing unit 50*a* has a pair of walls 50*c*, 50*c* separated at a specific interval as an extension of the extraction opening 50*b*. The interval between the walls 50*c*, 50*c* is roughly equal to the width of the sheet of staples S. Therefore, the sheet of staples S extending from the extraction opening 50*b* passes between the walls 50*c*, 50*c* in the direction of the arrow shown in FIG. 1.

Guides 51, 51 are placed on the cartridge 50 to prevent the sheet of staples S from riding up from the extraction opening 50*b*. In other words, the sheet of staples S is restrained widthwise by wall 100*c* and prevented from riding up by the guides 51, 51 so as to travel in the direction of the arrow. As shown in FIG. 1, a plate 52 is extended between the side walls 50*c*, 50*c*, and a reverse motion stopping tab 52*a* is formed on both ends of the plate 52. The reverse motion stopping tab 52*a* makes contact with the sheet of staples S to prevent the sheet of staples S from moving in the direction opposite to the arrow back into the housing unit 50*a*. In other words, the sheet of staples S moves in the direction of the arrow shown in FIG. 1, and is not allowed to return to the housing unit 50*a*.

The cartridge 50 is mounted in the main body of the device 70 shown in FIG. 2, and the pressure unit 53 formed in the cartridge 50 is brought to bear when the cartridge is mounted on the spring plate 55 on the advancing unit 54 of the main body of the device 70. The pressure from the spring plate 55 keeps the advancing unit 54 in the position shown in FIG. 2. When the driver 56 applying the staples is lowered from the position shown in FIG. 2, the protrusion 56*a* on the driver 56 is brought to bear on the protruding plate 54*a* formed on the advancing unit 54. Therefore, the lowering force of the driver 56 is communicated to the advancing unit 54 via the protrusion 56*a* and the protruding plate 54*a*, and the advancing unit 54 resists the spring action of the spring plate 55 and is rotated counterclockwise in the drawing. When the advancing unit 54 has traveled a full stroke, the protrusion 56*a* passes the position of the protruding plate 54*a*. When the protrusion 56*a* passes the position of the protruding plate 54*a*, the advancing unit 54 becomes free, and the advancing unit 54 subjected to the force of the spring 55 returns to its original position as shown in the figure.

An advancing tab 57 is located on the advancing unit 54. This advancing tab 57 makes elastic contact with the sheet of staples S extending from the cartridge 50. Therefore, the rotation of the advancing unit 54 causes the advancing tab 57 to advance the sheet of staples S in the direction of the driver 56. When the advancing unit 54 rotates counterclockwise, the advancing tab 57 makes and maintains elastic contact with the sheet of staples S. When the advancing unit 54 rotates counterclockwise, force is applied to return the sheet of staples S. However, the reverse motion stopping tab 52*a* prevents the sheet of staples from returning.

Often several cartridges are provided containing rolled sheets of staples of varying lengths. These cartridges can be replaced to provide the desired type of staples.

When a cartridge 50 is replaced in a stapler, the cartridge 50 is removed with the advancing tab 57 bearing down on the sheet of staples S. When a cartridge 50 is removed with the advancing tab 57 bearing down on the sheet of staples S, the sheet of staples S is pulled out from the cartridge 50. Because the revere movement stopping tab 52 bears down on the pulled out sheet of staples S, the staples do not return to their original position. As a result, some of the staples in the sheet of staples S are wasted.

Sometimes the cartridge 50 is divided in two and only the sheet of staples in the housing unit is replaced. However, even though the cartridge 50 is divided in two, the reverse motion stopping tab 52*a* continues to function and the section of the sheet of staples S drawn out by the reverse motion stopping tab 52*a* does not return to its original position. As a result, the section of the sheet of staples is wasted.

Therefore, there remains a need for a stapler that does not waste any staples when a staple cartridge or sheet of staples is replaced.

SUMMARY OF THE INVENTION

One embodiment of the invention relates to a stapler having a sheet of staples, a detachable cartridge for housing the sheet of staples and a driver mechanism for driving a staple withdrawn from the cartridge into a stack of paper. The main body of the device has a reverse motion stopping mechanism to prevent the sheet of staples from moving back into the cartridge, and the reverse motion stopping mechanism makes contact with the sheet of staples and the reverse motion stopping mechanism releases contact with the sheet of staples when the operating unit is operated.

Another embodiment of the invention relates to a stapler including a detachable cartridge for housing the sheet of staples and a driver mechanism for driving a staple withdrawn from the cartridge into a stack of paper. The mounting unit has a reverse motion stopping mechanism to prevent the sheet of staples from moving back into the cartridge, and the reverse motion stopping mechanism makes contact with the sheet of staples when the mounting unit is installed and the reverse motion stopping mechanism releases contact with the sheet of staples when the mounting unit is removed.

In yet another embodiment, the reverse motion stopping mechanism is a rotating unit such as a tab, a roller or an endless belt.

Another embodiment relates to a stapler including, a detachable cartridge for housing a sheet of staples and a driver mechanism for driving a staple withdrawn from the cartridge into a stack of paper. The mounting unit has an advancing mechanism for advancing the sheet of staples in the direction of the driver mechanism and a reverse motion stopping mechanism to prevent the sheet of staples from moving back into the cartridge. The advancing mechanism and the reverse motion stopping mechanism make contact with the sheet of staples when the mounting unit is installed and the advancing mechanism and the reverse motion stopping mechanism release contact with the sheet of staples when the mounting unit is removed.

The present invention is also directed to a stapler, where the mounting unit is equipped with an advancing mechanism casing constituting the advancing mechanism and a housing space for housing the advancing mechanism casing. The advancing mechanism casing is configured to move up and down inside the housing space. Spring action is applied to the advancing mechanism casing and the spring action normally extends upward from the housing space. The advancing mechanism and the reverse motion stopping mechanism are released from the sheet of staples in the extended state, and the advancing mechanism and the reverse motion stopping mechanism make contact with the sheet of staples when the advancing mechanism and the reverse motion stopping mechanism resist the spring action.

Another embodiment relates to a stapler, where the advancing mechanism is equipped with a shaft, a rotating unit rotating around the shaft, an moving plate engaged with the rotating unit and reciprocating as the rotating unit rotates, and an advancing tab mounted on the moving plate. The rotating unit rotates with the movement of the driver shaft supporting the driver mechanism.

The present invention is also directed to a stapler, where the advancing mechanism and the reverse motion stopping mechanism are rotating units such as a tab, a roller or an endless belt.

Another embodiment is stapler including a detachable cartridge for housing a sheet of staples and a driver mechanism for driving a staple withdrawn from the cartridge into a stack of paper. The main body of the device has an advancing mechanism for advancing the sheet of staples in the direction of the driver mechanism. The advancing mechanism has a reverse motion stopping mechanism, and the advancing mechanism and the reverse motion stopping mechanism make contact with the sheet of staples and release contact with the sheet of staples when the operating unit is operated.

Another embodiment also relates a stapler including a detachable cartridge for housing a sheet of staples, a driver mechanism designed and configured to drive a staple withdrawn from the cartridge into a stack of paper; and a mounting unit attached to the detachable cartridge. The mounting unit include a reverse motion stopping mechanism to prevent the sheet of staples from moving back into the cartridge, an advancing mechanism casing and a locking mechanism. The advancing mechanism casing has an advancing mechanism for advancing the sheet of staples in the direction of the driver mechanism and a housing space for housing the advancing mechanism casing. The advancing mechanism casing is configured to move from an up position to a down position inside the housing space and the locking mechanism locks the advancing mechanism casing in the down position. The advancing mechanism and the reverse motion stopping mechanism make contact with the sheet of staples and release contact with the sheet of staples when the stapler is operated.

DETAILED DESCRIPTION OF THE PREFERRED EMBODIMENTS

Figure 1:
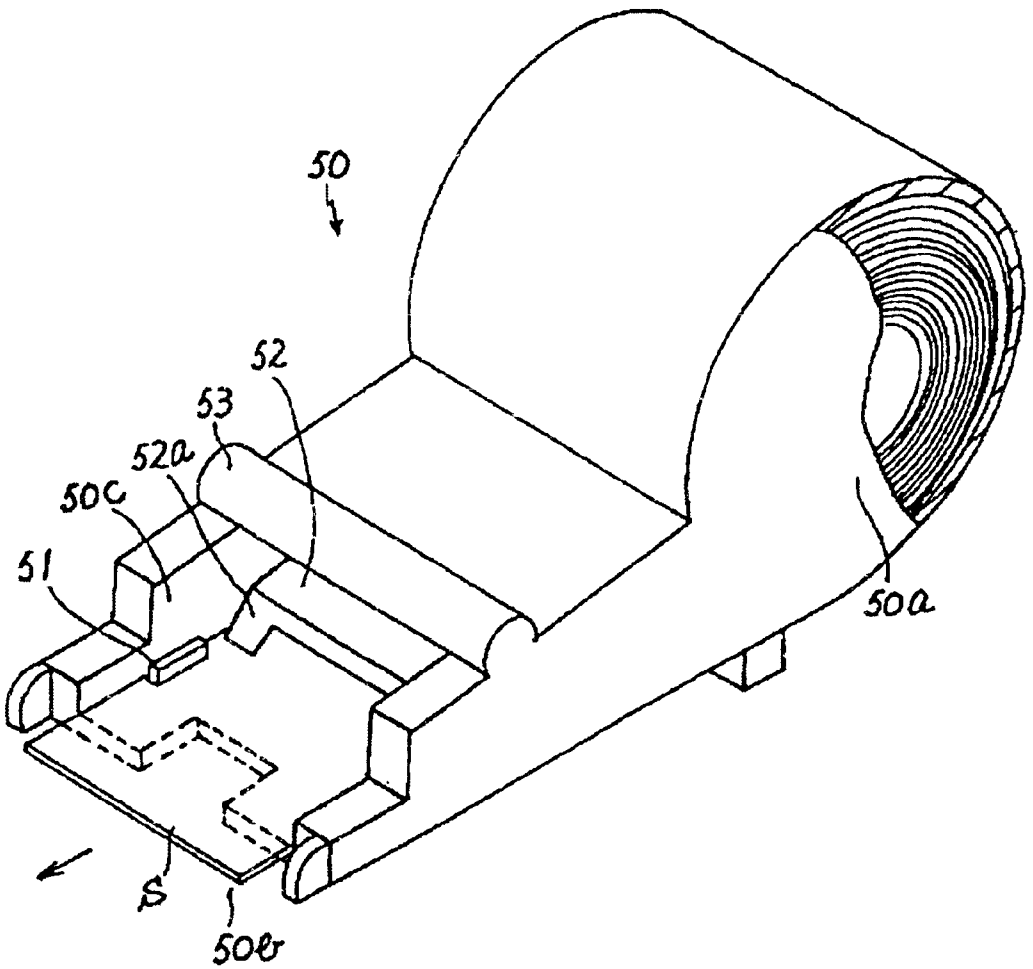
FIG. 1 is a perspective view of a cartridge of the prior art.
Figure 2:
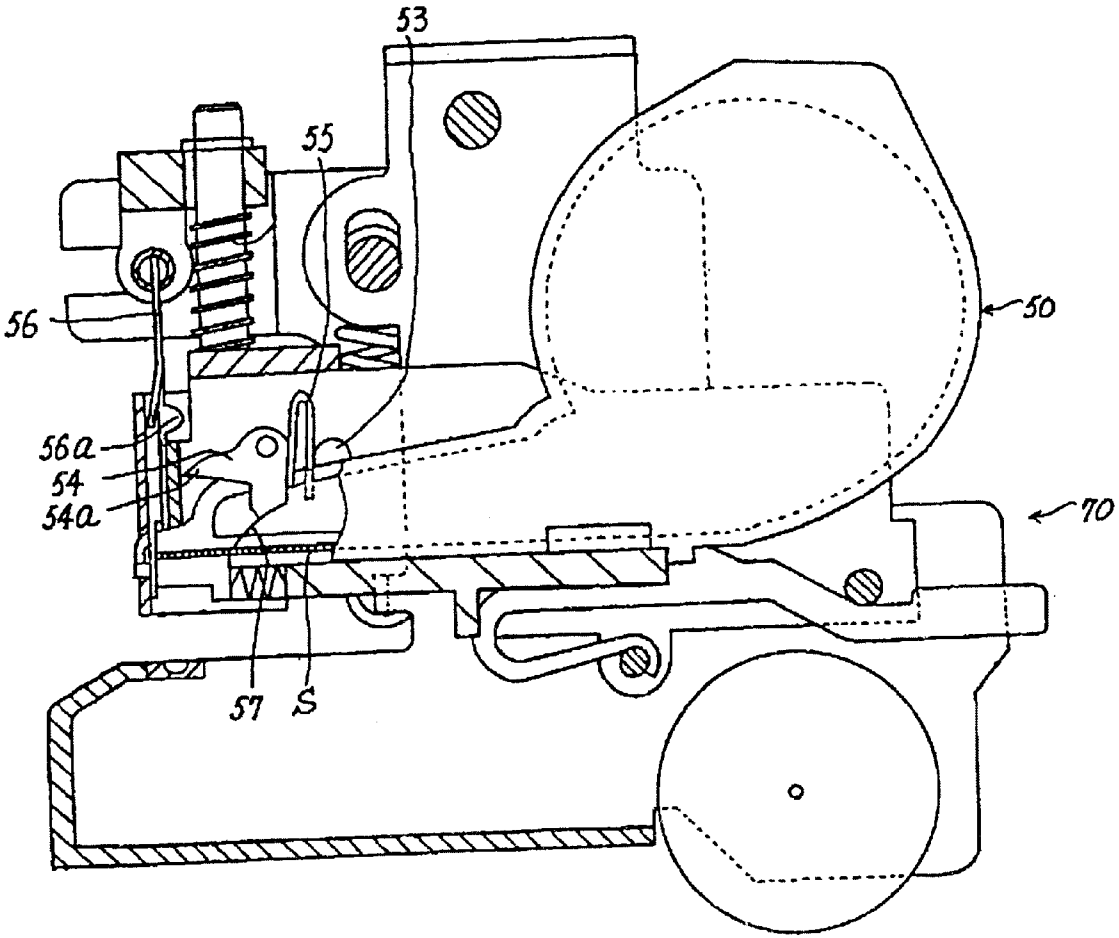
FIG. 2 is a cross-sectional view of a stapler of the prior art.
Figure 3:
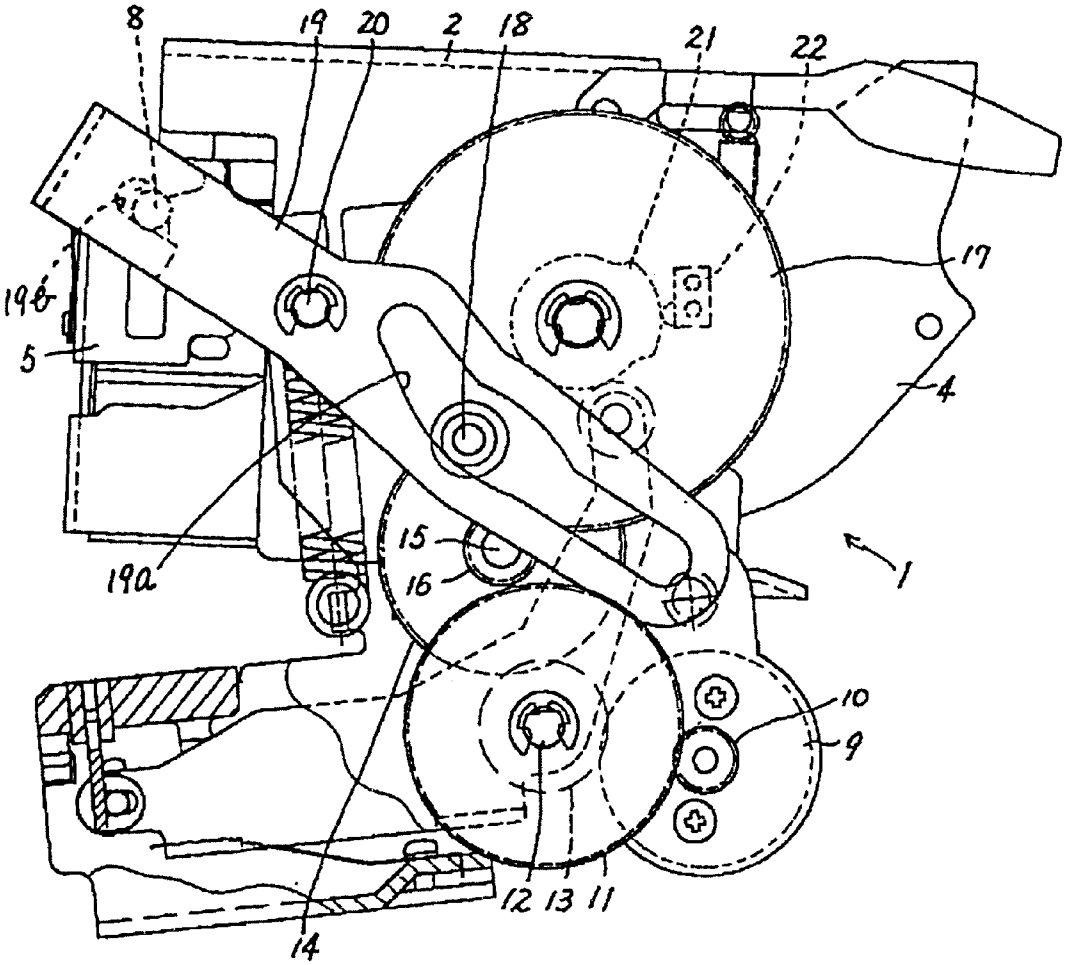
FIG. 3 is a lateral view of the stapler of the present invention.

The following is an explanation of a first embodiment of the present invention with reference to FIG. 3 through FIG. 7. FIG. 3 is a side view of the device 1 in the embodiment of the present invention. The front of the device 1 is on the left in the drawing and the back of the device 1 is on the right in the drawing.

Figure 4:
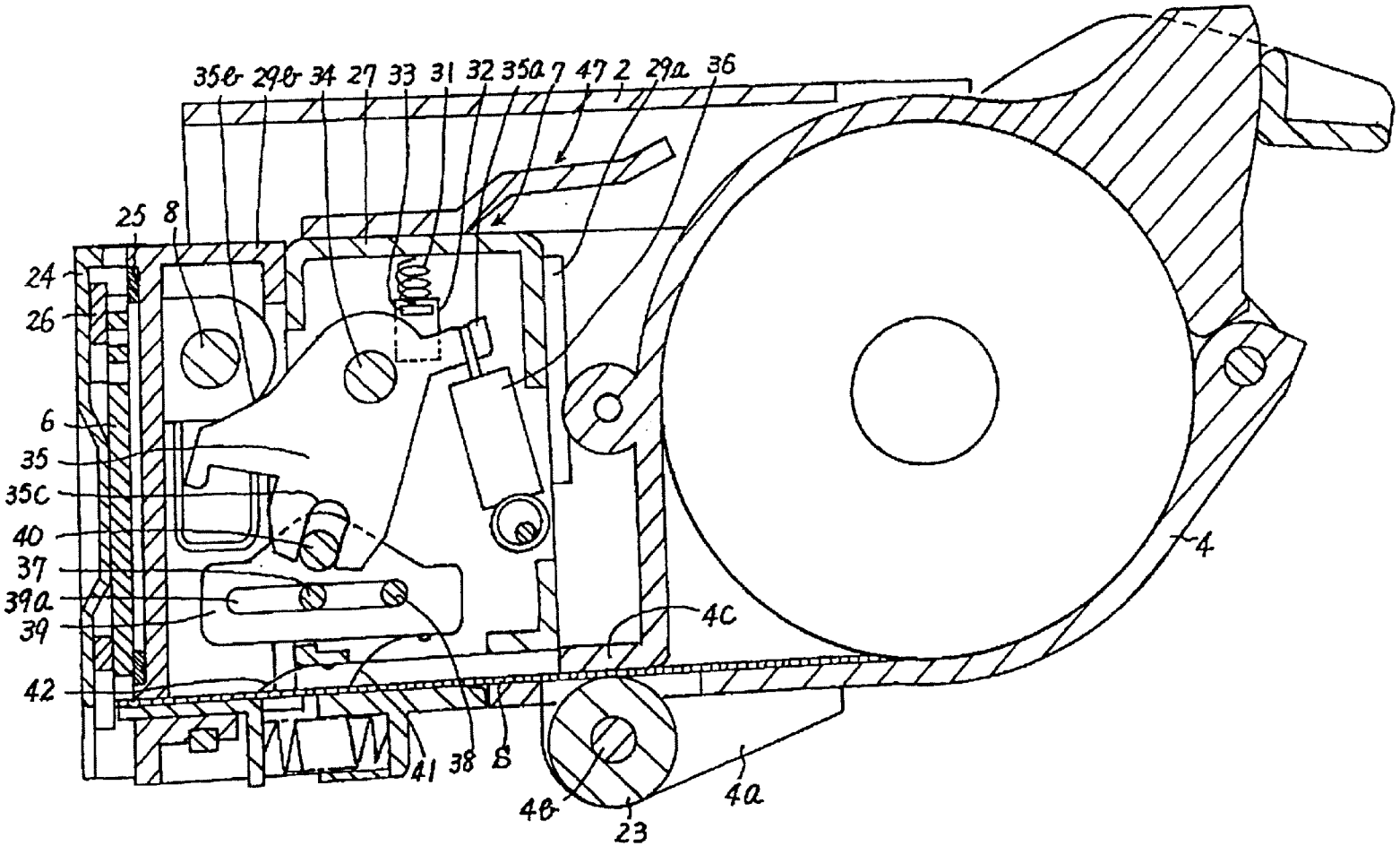
FIG. 4 is a cross-sectional view of the mounting unit.

As shown in FIG. 3 through FIG. 7, the mounting unit 3 is installed on the frame 2 of the device 1. As shown in FIG. 4, the cartridge 4 is installed on the back of the mounting unit 3. A sheet of staples S consisting of individual staples S1 is housed in the cartridge 4.

Figure 7:
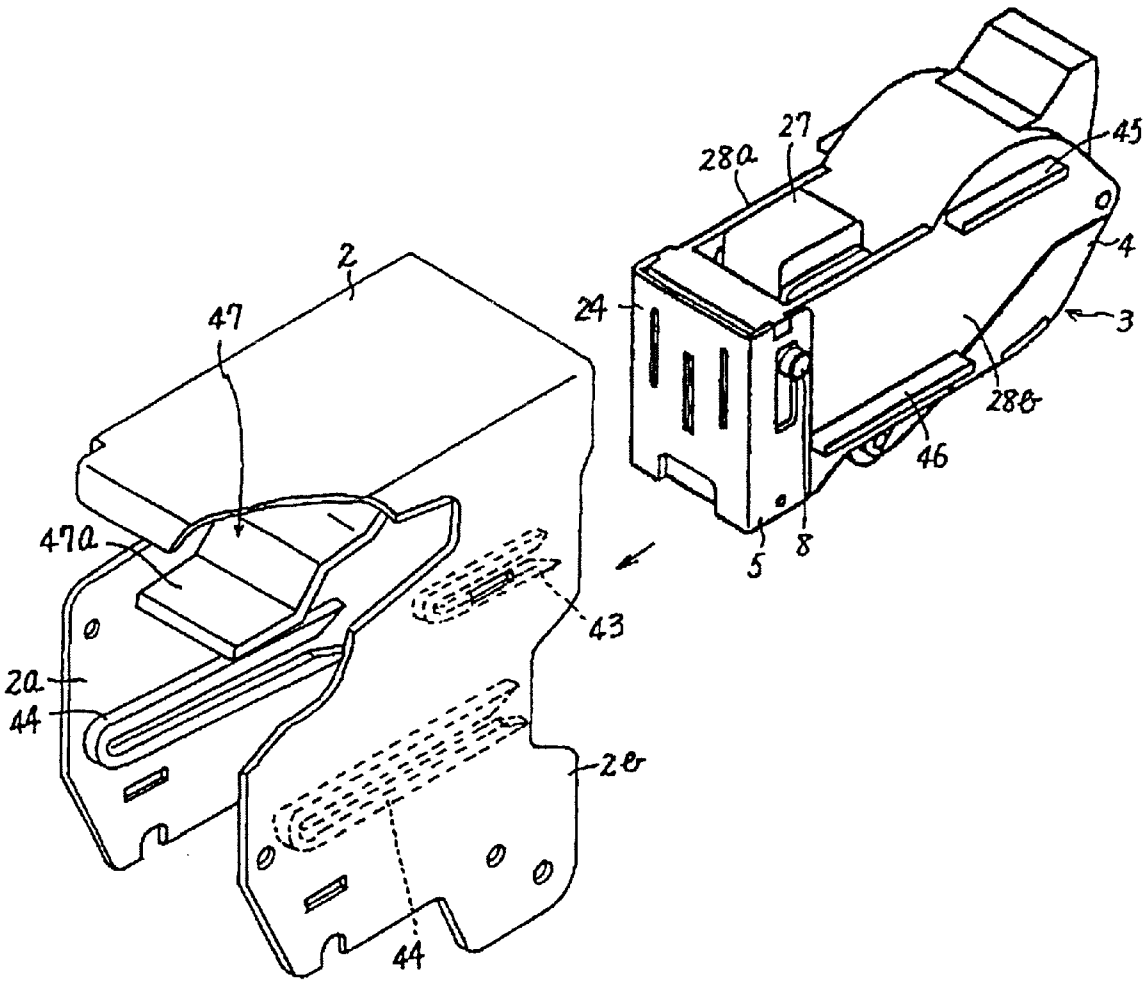
FIG. 7 is a perspective view of the frame and the mounting unit.

As shown in FIG. 7, the front block 5 of the device 1 is equipped with a driver mechanism 6 for driving a staple S1 through a stack of paper. As shown in FIG. 4, an advancing mechanism 7 is installed to advance a staple S1 to the driver mechanism 7. What follows is a detailed explanation of the driver mechanism 6 and the advancing mechanism 7.

As shown in FIG. 3, the side of the device 1 is equipped with a driver mechanism for operating the driver mechanism 6 and the advancing mechanism 7. FIG. 3 shows the stapling operation performed by the device 1. Here, the driver mechanism is located in the home position. The stapling operation and the operation of the advancing mechanism 7 involve the up and down movement of the drive shaft 8 in front of the device in FIG. 3.

As shown in FIG. 3, the device 1 is equipped with a drive motor 9. The pinion 10 attached to the output shaft of the drive motor 9 engages the first relay gear 11. The rotation of the output shaft from the drive motor 9 rotates the pinion 10 clockwise in FIG. 3, and the first relay gear 11 engaged with the pinion 10 is rotated counterclockwise. The first deceleration gear 13 is connected to the rotating shaft 12 of the first relay gear 11. As a result, the rotation of the first relay gear 11 rotates the first deceleration gear 13 counterclockwise.

The first deceleration gear 13 engages the second relay gear 14. Because the first deceleration gear 13 rotates counterclockwise, the second relay gear 14 rotates clockwise. The second deceleration gear 16 is attached to the rotating shaft 15 of the second relay gear 14. As a result, the rotation of the second relay gear 14 rotates the second deceleration gear 16 clockwise. The second deceleration gear 16 engages the gear of the drive wheel 17. When the second deceleration gear 16 rotates clockwise, the drive wheel 17 rotates counterclockwise.

An engagement pin 18 is attached to the drive wheel 17. As shown in FIG. 3, the engagement pin 18 is attached near the outer edge of the drive wheel 17. Also, the engagement pin 18 is inserted into the guide hole 19*a* in the driver arm 19. As a result, the movement of the engagement pin 18 is rotational around the center of the shaft 20. Here, the rotation of the drive wheel 17 moves the tip of the driver arm 19 up and down.

Both sides of the device 1 are equipped with a first deceleration gear 13, a second relay gear 14, a second deceleration gear 16 and a drive wheel 17.

A driver arm 19 is situated on both sides of the device 1. The tip of the driver arm 19 on both sides bends back to the rear, and a groove 19*b* is formed in the bent back portion. The driver shaft 8 extends between the grooves 19*b* in the driver arm 19 on both sides.

Because the driver shaft 8 is inserted into the grooves 19*b* in the driver arms 19, the driver shaft 8 moves up and down with the up and down movement of the front of the driver arms 19. The driving force of the drive motor 9 moves the driver shaft 8 up and down. The drive wheel 17 has a sensor 22 consisting of an attached cam 21 and a remit switch to detect the home position. The cam 21 turns the remit switch on in the home position. When the drive wheel 17 rotates once and returns to the home position, the sensor 22 identifies the home position and stops the drive motor 9.

Figure 6:
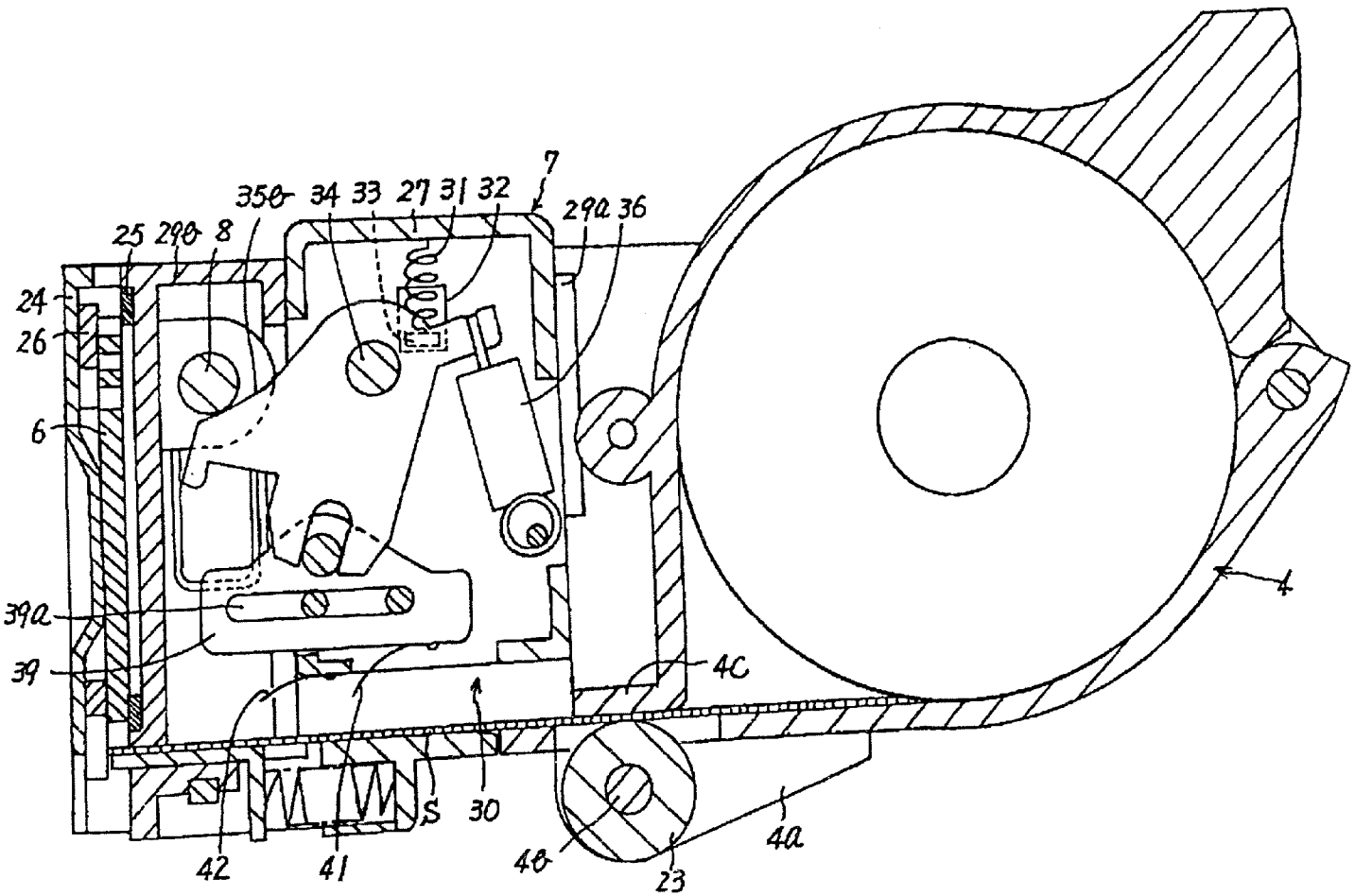
FIG. 6 is a cross-sectional view of the mounting unit when the mounting unit has been removed from the stapler.

The mounting unit 3 equipped with the driver mechanism 6 and advancing mechanism 7 for performing the stapling operation has the following configuration. FIG. 4 is a cross-sectional view of the mounting unit 3 when the driver mechanism is in the home position. FIG. 6 is a cross-sectional view of the mounting unit when the mounting unit has been removed from the stapler. The mounting unit 3 is equipped with the cartridge 4 and the front block 5 shown in FIG. 7 as well as the advancing mechanism 7 shown in FIG. 4.

A pair of roller supports 4*a* is situated on the bottom of the cartridge 4 installed in the mounting device 3. A shaft 4*b* extends between the roller supports 4*a*. A roller 23 is installed on the shaft 4*b* so as to rotate freely. A guide plate 4*c* is installed above the roller 23, and the sheet of staples S passed between the roller 23 and the guide plate 4*c*. When the sheet of staples S passes through, the roller 23 rotates and the sheet of staples S is extended out smoothly.

When the mounting unit 3 is installed in the device (not shown), the roller 23 makes contact with a plate-like roller guide. Therefore, when the mounting unit 3 is installed in the device, the roller 23 rotates and makes contact with the roller guide. The rotation of the roller 23 extends the sheet of staples S between the roller 23 and the guide plate 4*c*. When the end of sheet of staples S is extended to a certain position explained below, the roller 23 slips.

When the mounting unit 3 is installed in a certain position, the roller extends out from the roller guide and rotates freely. When the roller 23 extends out from the roller guide, the force of the extended sheet of staples S rotates the roller 23 and the sheet of staples S is extended out smoothly.

The following is an explanation of the front block 25 with reference to FIG. 4 and FIG. 7. A specific interval is established between the sheath 24 and the face plate 25 as shown in FIG. 4. The former 26 and the driver mechanism 6 are placed in between.

The driver shaft 8 then moves up and down to perform the following stapling operation. When the driver shaft 8 is lowered as shown in FIG. 4, the former 26 bends a staple S1 into an angular C-shape. When the driver shaft 8 is lowered again, angular C-shaped staple S1 is pressed by the driver mechanism 6 through a stack of paper. The position of the driver shaft 8 when applying pressure to the staple S1 is shown in FIG. 3.

The following is an explanation of the advancing mechanism 7 with reference to FIG. 4. The advancing mechanism 7 is equipped with a box-shaped advancing mechanism casing 27. The advancing mechanism casing 27 houses various elements with the following configuration.

The advancing mechanism casing 27 is installed in the mounting unit 3 so as to be able to move up and down. In other words, a pair of side wall plates 28*a*, 28*b* are in stalled in the mounting unit 3 as shown in FIG. 7, and a guide plate 29*a* and a front block plate 29*b* are placed between the side wall plates 28*a*, 28*b*. The side wall plates 28*a*, 28*b*, the guide plate 29*a* and the front block plate 29*b* form a housing space 30. The advancing mechanism casing 27 is installed in the housing space so as to be able to move up and down.

The upper ends of a pair of coil springs 31 compressed against the ceiling are attached to the advancing mechanism casing 27. The bottom ends of the pair of compressed coil springs 31 are fixed to the side wall plates 28*a*, 28*b*. The configuration is as follows. The side of the advancing mechanism casing 27 has a long hole 32 as shown in FIG. 3, and a spring receiving plate 33 is fixed inside the side wall plates 28*a*, 28*b*. The spring receiving plate 33 extends inside the advancing mechanism casing 27 from the long hole 32, and the bottom end of the compressed coil spring 31 is fixed to the extended end portion.

Therefore, the advancing mechanism casing 27 is maintained as shown in FIG. 7 so the ceiling extends above the side wall plates 28*a*, 28*b* to the extend it is acted upon by the force. As shown in FIG. 7, when the force acts on the ceiling, the advancing mechanism casing 27 is lowered against the spring action of the compressed coil spring 31.

Also, a shaft 34 is fixed between the side plates of the advancing mechanism casing 27, and the rotating unit 35 is attached to the shaft 34 so as to rotate freely. A protrusion 35*a* is formed in the upper rear section of the rotating unit 35, and one end of a coil spring 36 is attached to the protrusion 35*a* to apply spring action to the rotating unit 35. The spring action causes the rotating unit 35 to rotate counterclockwise as shown in FIG. 4.

A cam surface 35*b* is formed in the front of the rotating unit 35. The cam surface 35*b* moves along a track with the up and down movement of the driver shaft 8. As a result, the rotating unit 35 being acted upon by the spring also rotates with the up and down movement of the driver shaft 8.

Two stationary pins 37, 38 are formed on the bottom of the side plates in the advancing mechanism casing 27, and an moving plate 39 is attached to the stationary pins 37, 38. A long hole 39*a* is formed in the moving plate 39. The stationary pins 37, 38 pass through the long hole 39*a* so the moving plate 39 can move within the range of the long hole 39*a*. The direction of movement for the moving plate 39 matches the direction of movement for the sheet of staples S.

The engagement pin 40 is fixed to the moving plate 39 above the long hole 39*a*, and the engagement pin 40 is inserted into an engagement depression 35*c* formed in the rotating unit 35.

Therefore, the rotating unit 35 rotates counterclockwise in FIG. 4 around shaft 34, the engagement depression 35*c* slides, and the sliding moves the moving plate 39 forward.

The advancing tab 41 is fixed to the bottom of the moving plate 39, and the reverse motion stopping tab 42, which serves as the reverse motion restraining mechanism, is fixed to the bottom of the advancing mechanism casing 27. The advancing tab 41 and the reverse motion stopping tab 42 move downwards on a slope from the cartridge 4 to the front block 5.

When the advancing mechanism casing 27 resists the compressed coil spring 31 and moves downward as shown in FIG. 4, the advancing tab 41 and the reverse motion stopping tab 42 make contact with the sheet of staples S extending from the cartridge 4. When the advancing tab 41 makes contact with the sheet of staples S, the sheet of staples S is advanced in contact with the advancing tab 41 if the moving plate 39 moves in the direction of the advancing sheet of staples S.

The reverse motion stopping tab 42 makes contact with the sheet of staples S but only allows movement in the direction of the advancing sheet of staples S. As a result, the sheet of staples S cannot move back.

The following is an explanation of the method used to attach the mounting unit 3 to the frame 2 with reference to the cutaway section of the frame 2 shown in FIG. 7. In the mounting unit, upper support plates 45, 45 and lower support plates 46, 46 are attached to the outside of the side wall plates 28*a*, 28*b*. In the frame 2, upper guides 43, 43 and lower guides 44, 44 are attached to the inside of the side wall plates 2*a*, 2*b*. The guides 43, 44 restrict the upward and downward movement of the support plates 45, 46 but allow them to pull apart. The guides 43, 44 have U-shaped stoppers on the end. When the support plates 45, 46 come into contact with the stoppers, the mounting unit 3 is installed in the appropriate position on the frame 2.

A tiered advancing mechanism casing pressure unit 47 is installed on the ceiling of the frame 2. When the mounting unit 3 is installed in the frame 2, the lowest section 47*a* of the advancing mechanism casing pressure unit 47 presses the advancing mechanism casing 27 down and keeps it down as shown in FIG. 4. The advancing tab 41 and the reverse motion stopping tab 42 on the mounting unit 3 come into contact with the sheet of staples S.

When the driver shaft 8 is lowered to the home position as shown in FIG. 4, the driver shaft 8 resists the spring action of the coil spring 36 and presses down the cam surface 35*b* of the rotating unit 35. This rotates the rotating unit 35 counterclockwise as shown in FIG. 4.

If the rotating unit 35 is rotated counterclockwise, the moving plate 39 is moved towards the back of the cartridge 4. As a result, the advancing tab 41 attached to the moving plate 39 is also moved towards the cartridge 4.

Because the advancing tab 41 moves downward at a slope from the cartridge 4 to the front block 5, the advancing tab 41 applies returning force to the sheet of staples S when the advancing tab 41 moves toward the cartridge 4.

However, because there is a reverse motion stopping tab 42 making contact with the sheet of staples S beneath the advancing mechanism casing 27, the sheet of staples S cannot move back into the cartridge 4.

Because the sheet of staples S is prevented from moving back into the cartridge 4, there is no "firing of blanks" during the stapling operation.

Figure 5:
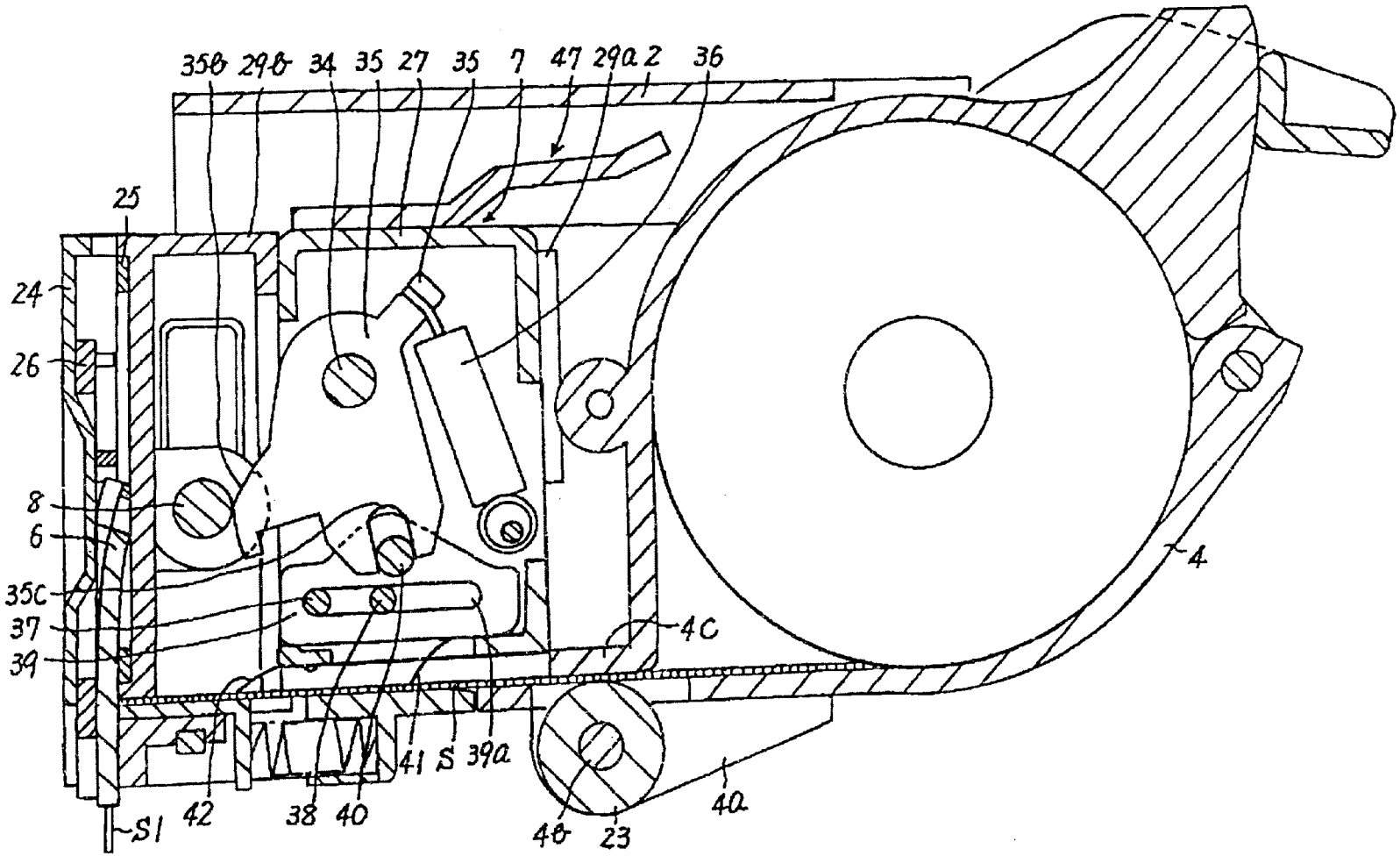
FIG. 5 is a cross-sectional view of the mounting unit during the operation of the driver mechanism.

When the moving plate 39 moves backward and the driver shaft 8 is at the lowest position as shown in FIG. 5, the driver shaft 8 begins to move upward. When the driver shaft 8 rises, the rotating unit 35 rotates clockwise in the figure and expands the coil spring 36. The moving plate 39 moves forward, the sheet of staples S in contact with the advancing tab 41 also moves forward. The amount of movement is equivalent to the thickness of a single staple S1.

When the operation of the advancing mechanism 7 is repeated, the sheet of staples S is continuously advanced toward the driver mechanism 6.

The advancing mechanism and the reverse motion preventing mechanism on the advancing mechanism are not restricted to plate-like tabs such as the advancing tab 41 and the reverse motion stopping tab 42. The advancing mechanism and the reverse motion preventing mechanism on the advancing mechanism can also be a rotating mechanism such as a roller or an endless belt.

The following is an explanation of the method used to remove the cartridge 4 housing the sheet of staples S from the mounting unit 3 with reference to FIG. 4. When the cartridge 4 is removed from the mounting unit, the mounting unit 3 has to first be removed from the device 1.

If the mounting unit 3 is removed from the device 1, the advancing mechanism casing 27 in the mounting unit 3 has to be released from the casing pressure unit 47. As a result, the advancing mechanism casing 27 is raised by the spring action of the compressed coil spring 31. In the raised position, the advancing tab 41 and the reverse motion stopping tab 42 are maintained at a position away from the sheet of staples S. The raised position is maintained by the spring receiving plate 33 coming into contact with the bottom of the long hole 32.

Because the advancing tab 41 and the reverse motion stopping tab 42 are maintained at a position away from the sheet of staples S when the mounting unit 3 is removed from the device 1, the advancing tab 41 and the reverse motion stopping tab 42 do not bear down on the sheet of staples S when the cartridge 4 is removed from the mounting unit 3. As a result, the sheet of staples S is not extended from the cartridge 4 when the cartridge 4 is removed from the mounting unit 3.

Because the reverse motion stopping tab 42 is separated from the staples, the extended section of the sheet of staples S simply returns to the cartridge 4. As a result, the extended section of the sheet of staples S is not severed and wasted.

Because the reverse motion stopping tab 42 is attached to the advancing mechanism 7 of the sheet of staples in the mounting unit 3 and the reverse motion stopping tab 42 is not attached to the cartridge 4, the extended section of the sheet of staples S extracted from the cartridge 4 in the mounting unit 3 by the advancing tab 41 can be returned.

In other words, the advancing tab 41 and the reverse motion stopping tab 42 are automatically released from the sheet of staples S by the spring action of the coil spring 39 attached to the advancing mechanism 7 when the mounting unit 3 is removed. Also, the staples do not remain extended when the cartridge 4 is extracted.

If the advancing tab 41 and the reverse motion stopping tab 42 in this embodiment are replaced by a rubber rotating unit, the force with which the rotating unit makes contact with the sheet of staples S is weaker when the cartridge 4 is removed.

When the mounting unit 3 is removed from the device 1, the advancing tab 41 and the reverse motion stopping tab 42 are separated from the sheet of staples S by the spring action of the compressed coil spring 31. The advancing mechanism 7 can also be raised manually.

Since the advancing tab 41 and the reverse motion stopping tab 42 make contact with the sheet of staples S and separate from the sheet of staples S, the mounting unit 3 can have the following configuration. In this configuration, the pressure unit 47 can be placed on the frame 2.

The upper end of the side walls 28*a*, 28*a* in the mounting unit 3 are bend inward, and a plate is manually inserted from the end with the driver mechanism 6 between the bent portion and the advancing mechanism casing 27. When the plate is inserted between the bent portion and the advancing mechanism casing 27 in this configuration, the plate bears down on the advancing mechanism casing 27. The advancing tab 41 and the reverse motion stopping tab 42 make contact with the sheet of staples S and are maintained in this position. When the plate is removed from between the bent section and the advancing mechanism casing 27, the advancing mechanism casing 27 extends upwards and the advancing tab 41 and the reverse motion stopping tab 42 are separated from the sheet of staples S.

The following is an explanation of another configuration. A mechanism that locks when the advancing mechanism casing 27 is pressed down can be attached to the mounting unit 3. When the advancing mechanism casing 27 is pressed down manually, the locking mechanism makes sure the pressure unit 47 applies pressure to the advancing mechanism casing 27. The locking mechanism can be released by operating a button or lever. In this configuration, the mounting unit 3 is installed in the device 1, and the advancing tab 41 and the reverse motion stopping tab 42 come into contact with the sheet of staples S. The advancing tab 41 and the reverse motion stopping tab 42 can be released from the sheet of staples S by operating a button or lever. Here, the plate, button and lever are manually operated units. In this configuration, the device 1 and the mounting unit 3 are integrated and the cartridge 4 is extracted without removing the mounting unit 3.

In one embodiment, a reverse motion stopping mechanism is installed in the device and the reverse motion stopping mechanism is separated from the sheet of staples by operating a control unit. As a result, the extended sheet of staples is returned to the cartridge when the cartridge is removed from the main body of the device. In another embodiment, the reverse motion stopping mechanism makes contact with the sheet of staples when the mounting unit is installed in the main body of the device, and the reverse motion stopping mechanism is released from the sheet of staples when the mounting unit is removed from the main body of the device. As a result, the extended sheet of staples is returned to the cartridge when the cartridge is removed from the main body of the device.

In another embodiment, the reverse motion stopping mechanism is mounted on the advancing mechanism and is released from the sheet of staples when the mounting unit is removed from the main body of the device. Because the advancing mechanism and the reverse motion stopping mechanism attached to the advancing mechanism do not act upon the sheet of staples when the cartridge is removed from the mounting unit, the sheet of staples is not extended unnecessarily. Because the reverse motion stopping mechanism is separated from the sheet of staples, the extended section of the sheet of staples simply returns to the cartridge when the sheet of staples has to be extended. As a result, the extended section of the sheet of staples is not wasted.

In another embodiment, the advancing mechanism casing is extended upwards by spring action when the mounting unit is removed from the main body of the device. As a result, the advancing mechanism and the reverse motion stopping mechanism are automatically released from making contact with the sheet of staples.

In another embodiment, the advancing mechanism and the reverse motion stopping mechanism make contact with the sheet of staples when the mounting unit is installed in the main body of the device. Even though the movement of the advancing mechanism towards the cartridge moves the sheet of staples towards the cartridge, the reverse motion stopping mechanism prevents movement of the sheet of staples towards the cartridge. Because the sheet of staples is prevented from returning to the cartridge, the device doesn't "fire blanks" during the stapling operation.

In one more embodiment, the mounting unit is mounted in the device and the advancing mechanism and the reverse motion stopping mechanism are separated from the sheet of staples by operating a button or lever. As a result, the sheet of staples is not unnecessarily extended when the cartridge is removed.

It should be understood that variations and modifications within the spirit and scope of the invention may occur to those skilled in the art to which the invention pertains. Accordingly, all expedient modifications readily attainable by one versed in the art from the disclosure set forth herein that are within the scope and spirit of the present invention are to be included as further embodiments of the present invention. The scope of the present invention accordingly is to be defined as set forth in the appended claims.

What is claimed:

1. A stapler comprising:

a main body;

a detachable cartridge attached to the main body for housing a sheet of staples; and a driver mechanism configured to drive a staple withdrawn from the cartridge into a stack of paper, wherein the main body of the device has a reverse motion stopping mechanism configured to substantially prevent the sheet of staples from moving back into the cartridge, and wherein the reverse motion stopping mechanism makes contact with the sheet of staples to substantially prevent the sheet of staples from moving back into the cartridge when the stapler is operated and the reverse motion stopping mechanism releases contact with the sheet of staples to allow for detachment of the cartridge without substantially withdrawing the sheet of staples further from the cartridge.

2. The stapler of claim 1, wherein the reverse motion stopping mechanism includes a tab configured to engage the sheet of staples.

3. The stapler of claim 2, wherein the tab is selectively movable into and out of engagement with the sheet of staples.

4. The stapler of claim 3, wherein the tab is biased out of engagement with the sheet of staples.

5. The stapler of claim 1, wherein the reverse motion stopping mechanism includes a casing and a tab coupled to the casing, both the casing and the tab being movable with respect to the main body.

6. The stapler of claim 5, wherein the casing and the tab are biased away from the sheet of staples.

7. The stapler of claim 6, further comprising a frame configured to receive the main body, the frame including a pressure unit configured to engage the casing and overcome the bias, thereby causing the tab of the reverse motion stopping mechanism to contact the sheet of staples.

8. The stapler of claim 5, wherein the casing also supports an advancing mechanism for advancing the sheet of staples in the direction of the driver mechanism.

9. The stapler of claim 8, wherein the advancing mechanism selectively makes contact with the sheet of staples when the stapler is operated and releases contact with the sheet of staples to allow for detachment of the cartridge without substantially withdrawing the sheet of staples further from the cartridge.

10. The stapler of claim 8, wherein the advancing mechanism is a rotating unit having an advancing tab.

11. The stapler of claim 8, wherein the advancing mechanism includes a shaft;

a rotating unit rotating around the shaft;

a moving plate engaged with the rotating unit and reciprocating as the rotating unit rotates; and an advancing tab mounted on the moving plate, wherein the rotating unit rotates with the movement of the driver shaft supporting the driver mechanism.

12. A stapler comprising:

a mounting unit;

a detachable cartridge attached to the mounting unit for housing a sheet of staples; and a driver mechanism configured to drive a staple withdrawn from the cartridge into a stack of paper, wherein the mounting unit has a reverse motion stopping mechanism configured to substantially prevent the sheet of staples from moving back into the cartridge, and wherein the reverse motion stopping mechanism makes contact with the sheet of staples when the mounting unit is installed and the reverse motion stopping mechanism releases contact with the sheet of staples when the mounting unit is removed.

13. The stapler of claim 12, wherein the reverse motion stopping mechanism includes a tab configured to engage the sheet of staples.

14. The stapler of claim 13, wherein the tab is selectively movable into and out of engagement with the sheet of staples.

15. The stapler of claim 14, wherein the tab is biased out of engagement with the sheet of staples.

16. The stapler of claim 12, wherein the reverse motion stopping mechanism includes a casing and a tab coupled to the casing, both the casing and the tab being movable with respect to the mounting unit.

17. The stapler of claim 16, wherein the casing and the tab are biased away from the sheet of staples.

18. The stapler of claim 17, further comprising a frame configured to receive the mounting unit, the frame including a pressure unit configured to engage the casing and overcome the bias, thereby causing the tab of the reverse motion stopping mechanism to contact the sheet of staples.

19. The stapler of claim 16, wherein the casing also supports an advancing mechanism for advancing the sheet of staples in the direction of the driver mechanism.

20. The stapler of claim 19, wherein the advancing mechanism selectively makes contact with the sheet of staples when the mounting unit is installed and releases contact with the sheet of staples when the mounting unit is removed.

21. The stapler of claim 19, wherein the advancing mechanism is a rotating unit having an advancing tab.

22. The stapler of claim 19, wherein the advancing mechanism includes a shaft;

a rotating unit rotating around the shaft;

a moving plate engaged with the rotating unit and reciprocating as the rotating unit rotates; and an advancing tab mounted on the moving plate, wherein the rotating unit rotates with the movement of the driver shaft supporting the driver mechanism.

* * * * *